US007360600B2

(12) United States Patent
MacDougall et al.

(10) Patent No.: US 7,360,600 B2
(45) Date of Patent: Apr. 22, 2008

(54) SUBSURFACE SAFETY VALVES AND METHODS OF USE

(75) Inventors: Thomas D. MacDougall, Sugar Land, TX (US); Dwayne E. May, Humble, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/306,285

(22) Filed: Dec. 21, 2005

(65) Prior Publication Data

US 2007/0137869 A1 Jun. 21, 2007

(51) Int. Cl.
*E21B 34/12* (2006.01)

(52) U.S. Cl. ..... 166/332.8; 166/323; 166/373; 166/386

(58) Field of Classification Search ..... 166/332.8, 166/373, 323, 386
See application file for complete search history.

(56) References Cited

U.S. PATENT DOCUMENTS

| | | | | |
|---|---|---|---|---|
| 4,161,219 | A | 7/1979 | Pringle | |
| 4,220,206 | A * | 9/1980 | Van Winkle | 166/318 |
| 4,574,889 | A | 3/1986 | Pringle | |
| 4,605,070 | A | 8/1986 | Morris | |
| 4,722,399 | A | 2/1988 | Pringle | |
| 4,723,606 | A * | 2/1988 | Vinzant et al. | 166/319 |
| 4,926,945 | A | 5/1990 | Pringle | |
| 5,165,480 | A | 11/1992 | Wagoner | |
| 5,167,284 | A | 12/1992 | Leismer | |
| 6,079,497 | A | 6/2000 | Johnston | |
| 6,237,693 | B1 | 5/2001 | Deaton | |
| 6,619,388 | B2 * | 9/2003 | Dietz et al. | 166/66.7 |

FOREIGN PATENT DOCUMENTS

GB 2375559 A2 11/2002

* cited by examiner

*Primary Examiner*—Giovanna C Wright
(74) *Attorney, Agent, or Firm*—Trop, Pruner & Hu, P.C.; Daryl R. Wright; Bryan P. Galloway

(57) ABSTRACT

A subsurface safety valve comprises a tubular body adapted for placement within a wellbore and defining a fluid passageway. A valve closure member, such as a flapper valve, is carried by the tubular body and movable through a closure path between positions opening and closing the fluid passageway. An actuator, such as a biasing spring, urges the valve closure member to its closing position. A flow tube is axially-movable within the tubular body between a first position preventing the actuator from urging the valve closure member to its closing position and a second position permitting the actuator to urge the valve closure member to its closing position. A latch assembly is provided for preventing movement of the valve closure member from its opening position to its closing position until the flow tube has been urged clear of the closure path. Aspects of the safety valve are employed by a related method and system.

23 Claims, 6 Drawing Sheets

SUBSURFACE SAFETY VALVES AND METHODS OF USE

BACKGROUND OF THE INVENTION

1. Field of the Invention

The present invention relates to subsurface safety valves for controlling fluid flow in tubing or conduit disposed in a wellbore penetrating subsurface strata.

2. Background of the Related Art

A subsurface safety valve, also known simply as a safety valve, is an apparatus that is used in various wellbore types (e.g., subsea, platform, land-based) to provide a "fail-safe" mechanism for closing the wellbore to prevent the uncontrolled release of hydrocarbons or other downhole fluids. A safety valve is typically actuated in emergency situations, such as blowouts, to provide a pressure barrier (oftentimes in cooperation with blowout preventers) and safeguard local personnel, equipment, and the environment.

U.S. Pat. No. 4,161,219 discloses a safety valve that employs a flapper valve that is spring-biased towards a position closing a fluid passageway in the safety valve body, and a flow tube that is normally positioned so as to yield the biasing spring of the flapper valve and secure the flapper valve into a position opening the fluid passageway. The flow tube is also spring biased towards an upper position that releases the flapper valve, but the flow tube is normally urged towards a lower position in which the flapper valve is secured by the application of a control fluid pressure from the surface. In the event of an emergency, such as a blowout, the control fluid pressure is reduced to permit the spring bias of the flow tube to urge the flow tube towards its upper position, thereby releasing the flapper valve so that its biasing spring urges the flapper valve towards the position closing the fluid passageway.

When the flapper valve of a conventional safety valve is released from its opening position, fluid pressure in the fluid passageway as well as the flapper valve's spring bias apply a closing force to the flapper valve. In high-flowrate wellbores, this closing force effects a relatively rapid closing motion that causes the flapper valve to impart substantial loading conditions on the lower end of the flow tube, as well as the flapper hinge mechanism. In other words, the flow tube is not moved fast enough by its biasing spring to avoid the closing movement of the flapper mechanism. As a result of the expected loading forces between the flapper mechanism and flow tube, the flow tube must typically be strengthened by way of increased wall thickness and the flapper hinge mechanism strengthened by increasing material strengths and/or material web sections to avoid incapacitating damage. The increased wall thickness of the flow tube and/or increased hinge web section effectively compromises the safety valve's internal diameter and therefore reduces the resultant fluid flow capacity through the safety valve.

A need therefore exists for a safety valve that mitigates the risk of damage by the extremely high loading forces between a flapper mechanism and a flow tube.

A further need exists for a safety valve that mitigates such risk without compromising fluid flow capacity.

SUMMARY OF THE INVENTION

The above-described needs, problems, and deficiencies in the art, as well as others, are addressed by the present invention in its various aspects and embodiments. In one aspect, the present invention provides a subsurface safety valve for controlling fluid flow through a wellbore. The safety valve comprises a tubular body adapted for placement within the wellbore and defining a fluid passageway. A valve closure member is carried by the tubular body and is movable through a closure path between positions opening and closing the fluid passageway, and a first actuator is provided for urging the valve closure member to its closing position. A flow tube is axially-movable within the tubular body between a first position preventing the first actuator from urging the valve closure member to its closing position and a second position permitting the first actuator to urge the valve closure member to its closing position. A latch assembly is provided for preventing movement of the valve closure member from its opening position to its closing position until the flow tube has been urged clear of the closure path.

In particular embodiments, the valve closure member is a flapper carried by the tubular body for pivotal movement through an arcuate closure path.

The first actuator may comprise a spring, such as a hinge spring in embodiments where the valve closure member is a flapper.

Particular embodiments of the safety valve further comprise a control passageway in the tubular body for transmitting fluid pressure from the surface for urging the flow tube towards its first position. In such embodiments, the safety valve may further comprise a second actuator for urging the flow tube toward its second position, whereby the magnitude of fluid pressure transmitted via the control passageway determines whether the flow tube will be urged towards its first or second position. The second actuator may comprise a spring, such as a helical spring disposed between a shoulder carried by the tubular body and a shoulder carried by the flow tube.

In particular embodiments of the safety valve, the latch assembly comprises a keeper carried by the valve closure member, a latch carried by the tubular body for operatively engaging the keeper, and an actuator for releasing the keeper from the latch. In such embodiments, the latch may be carried by the tubular body for pivotal movement between a first position for operatively engaging the keeper and a second position for releasing the keeper. The latch may comprise a spring for biasing the latch towards its first position.

Additionally, in such embodiments, the tubular body and the flow tube may define an annulus therebetween, and the latch actuator may comprise a first boss member slidably carried within an axial slot in the tubular body and having a portion protruding into the annulus, and a second boss member carried by the flow tube for movement therewith and having a portion protruding into the annulus. The protruding portions of the first and second boss members may interfere radially with one another such that neither can be moved axially through the length of the annulus without engaging the other. A linkage may be connected between the first boss member and the latch such that movement of the flow tube from its first position to its second position forces the second boss member into engagement with the first boss member, resulting in pivotal movement of the latch from its first position to its second position, whereby the valve closure member is urged to its closing position by the first actuator when the flow tube is clear of the closure path.

In particular embodiments of the safety valve, the latch actuator is electromechanical and comprises a first position sensor element carried by the tubular body, and a second position sensor element carried by the flow tube for movement therewith. At least one of the first and second position sensor elements may generate a release signal when the flow tube is moved to a position that axially aligns the two position-sensing elements. The electromechanical actuator further comprises an electromechanical linkage operatively connected between the one signal-generating position sensor element and the latch such that movement of the flow tube from its first position to its second position aligns the second position sensor element with the first position sensor element, resulting in the transmission of a release signal to the electromechanical linkage and the movement of the latch from its first position to its second position. In this manner, the valve closure member is urged to its closing position by the first actuator when the flow tube is clear of the closure path.

In another aspect, the present invention relates to a system for actuating a valve closure member within a subsurface safety valve having a tubular body adapted for placement within a wellbore and defining a fluid passageway. The valve closure member is carried by the tubular body for movement through a closure path between positions opening and closing the fluid passageway. The safety valve further has a first actuator for urging the valve closure member to its closing position, and a flow tube axially-movable within the tubular body between a first position preventing the first actuator from urging the valve closure member to its closing position and a second position permitting the first actuator to urge the valve closure member to its closing position. The actuating system comprises a latch assembly for preventing movement of the valve closure member from its opening position to its closing position until the flow tube has been urged clear of the closure path.

In particular embodiments of the actuating system, the latch assembly comprises a keeper carried by the valve closure member, a latch carried by the tubular body for operatively engaging the keeper, and an actuator for releasing the keeper from the latch. In such embodiments, the latch actuator may be mechanical, electromechanical, or electrical.

In another aspect, the present invention relates to a method for controlling fluid flow through a fluid passageway in a tubular body disposed in a wellbore. The method comprises the steps of urging a flow tube within the tubular body to a first position preventing a valve closure member from moving under a spring bias through a closure path from a position opening the fluid passageway to a position closing the fluid passageway, urging the flow tube to a second position permitting movement of the valve closure member under the spring bias, and securing the valve closure member in the opening position until the flow tube has been moved clear of the closure path.

In particular embodiments of the method, the flow tube first position-urging step comprises applying fluid pressure from a surface location.

In particular embodiments of the method, the flow tube second position-urging step comprises reducing fluid pressure from the surface location, and applying a spring bias force against the flow tube that opposes and exceeds the force of the reduced fluid pressure.

The securing step may be performed by a latch assembly. The latch assembly may comprise a keeper carried by the valve closure member, a latch carried by the tubular body for operatively engaging the keeper, and an actuator for releasing the keeper from the latch.

BRIEF DESCRIPTION OF THE DRAWINGS

A more particular description of the invention, briefly summarized above, is provided by reference to embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1A:
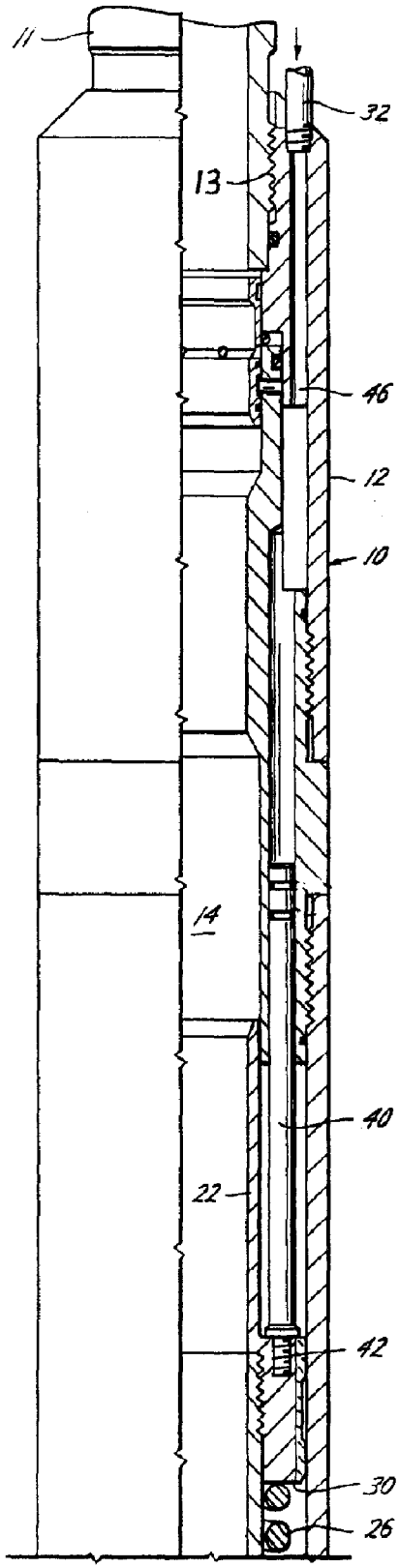
FIGS. 1A and 1B are complementing elevational views, partly in cross section, of respective upper and lower portions of a subsurface safety valve according to the present invention.
Figure 1B:
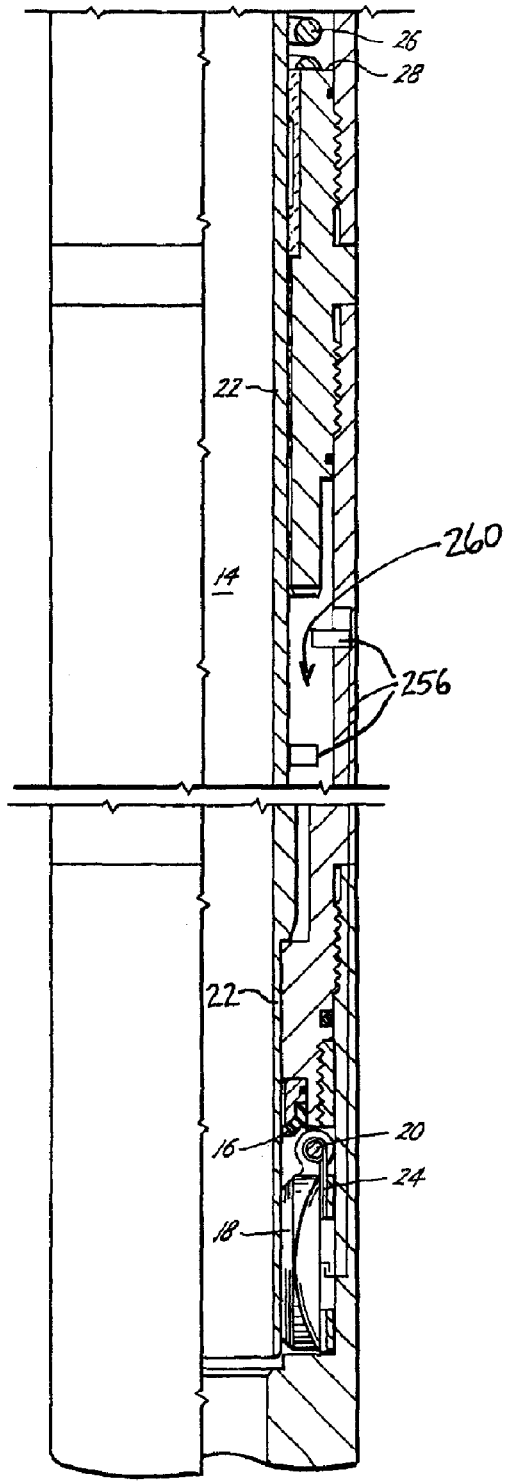

Referring now to the drawings, and in particular to FIGS. 1A-1B and 2A-2D, the subsurface safety valve of the present invention is generally indicated by the reference numeral 10 and is shown as being of a nonretrievable type for connection in a wellbore conduit or tubing string 11 such as by a threaded box 13 at one end and a threaded pin (not shown) at the other end for connecting the safety valve 10 directly into the tubing string 11 of a wellbore.

The safety valve 10 generally includes a tubular body or housing 12 adapted to be connected in the wellbore tubing string 11 to form a part thereof. The tubular body 12 defines a fluid passageway or bore 14 to permit hydrocarbon (or other downhole fluid) production therethrough under normal operating conditions. The safety valve 10 is adapted to close or be closed in response to abnormal conditions such as might occur when the well overproduces, blows wild, or in event of failure of well equipment.

For this purpose, the safety valve 10 is equipped with a valve closure member, typically a flapper valve 18, carried by the tubular body 12 and movable through a closure path CP (see FIGS. 2C-2D) between positions opening and closing the fluid passageway. It will be appreciated, however, by those having ordinary skill in the art that the present invention is not limited flapper-type valve closure members, and that other valve closure member types may be employed to advantage. The flapper valve 18 is pivotally connected to the tubular body 12 by a pivot pin 20, and cooperates with an annular valve seat 16 positioned about the fluid passageway 14 for effecting closure of the safety valve 10. Thus, when the flapper 18 is in the upper position and seated on the valve seat 16 (see FIG. 2D), the safety valve 10 is closed blocking flow upwardly through the passageway 14 and the wellbore tubing 11. An actuator, in the form of a biasing hinge spring 24, is provided for urging the flapper valve 18 to its closing position.

A flow tube 22 is axially-movable (i.e., slidable) through the valve seat 16 within the tubular body 12 between a first position (see FIGS. 1B and 2A) preventing the hinge spring 24 from urging the flapper valve 18 to its closing position, and a second position (see FIG. 2C) permitting the hinge spring 24 to urge the flapper valve 18 to its closing position.

A latch assembly 256 is provided for preventing movement of the flapper valve 18 from its opening position (see FIGS. 1B, 2A) to its closing position (see FIG. 2D) until the flow tube 22 has been urged clear of the arcuate closure path CP (see FIGS. 2C-2D) defined by the opening position (see broken line $P_1$) and the closing position (see broken line $P_2$) of the leading surface 18*a* of the flapper valve 18. In the particular embodiment of FIGS. 2A-2D, the latch assembly is mechanical and comprises a keeper 252 carried by the flapper valve 18, a latch 254 carried by the tubular body 12 for operatively engaging the keeper 252, and an actuator 256 for releasing the keeper 252 from the latch 254.

The latch 254 is carried by the tubular body 12 for pivotal movement between a first position (see FIG. 2A) for operatively engaging the keeper 252, and a second position (see FIG. 2C) for releasing the keeper 252. The latch 254 and keeper 252 employ complementing hook-like portions (not numbered, but clearly shown in FIGS. 2A-2C) for achieving engagement with one another. The latch 254 may comprise a hinge spring (not shown) associated with a mounting pin 255 for biasing the latch towards its first, keeper-engaging position.

The actuator 256 comprises an elongated linkage such as a cable, wire, or similar member 256*a* that is capable of transmitting a pivoting force to the latch 254 from another location. Thus, a cable 256*a* may be extended through a small-diameter passageway or bore (not separately shown in the figures, for simplicity) in the tubular body 12.

In the embodiment of FIGS. 1B and 2A-2D, the tubular body 12 and the flow tube 22 define an annulus 260 therebetween. The latch actuator 256 additionally comprises a first boss member 256*b* slidably carried within an axial slot 258 in the tubular body 12 and having a portion 257*b* protruding into the annulus 260. The latch actuator 256 further comprises a second boss member 256*c* carried by the flow tube 22 for movement therewith and having a portion 257*c* protruding into the annulus 260. The protruding portions 257*b*, 257*c* of the first and second boss members 256*b*, 256*c* interfere radially with one another such that the second boss member 256*c* cannot be moved axially through the length of the annulus 260 without engaging the first boss member 256*b*.

Figure 2A:
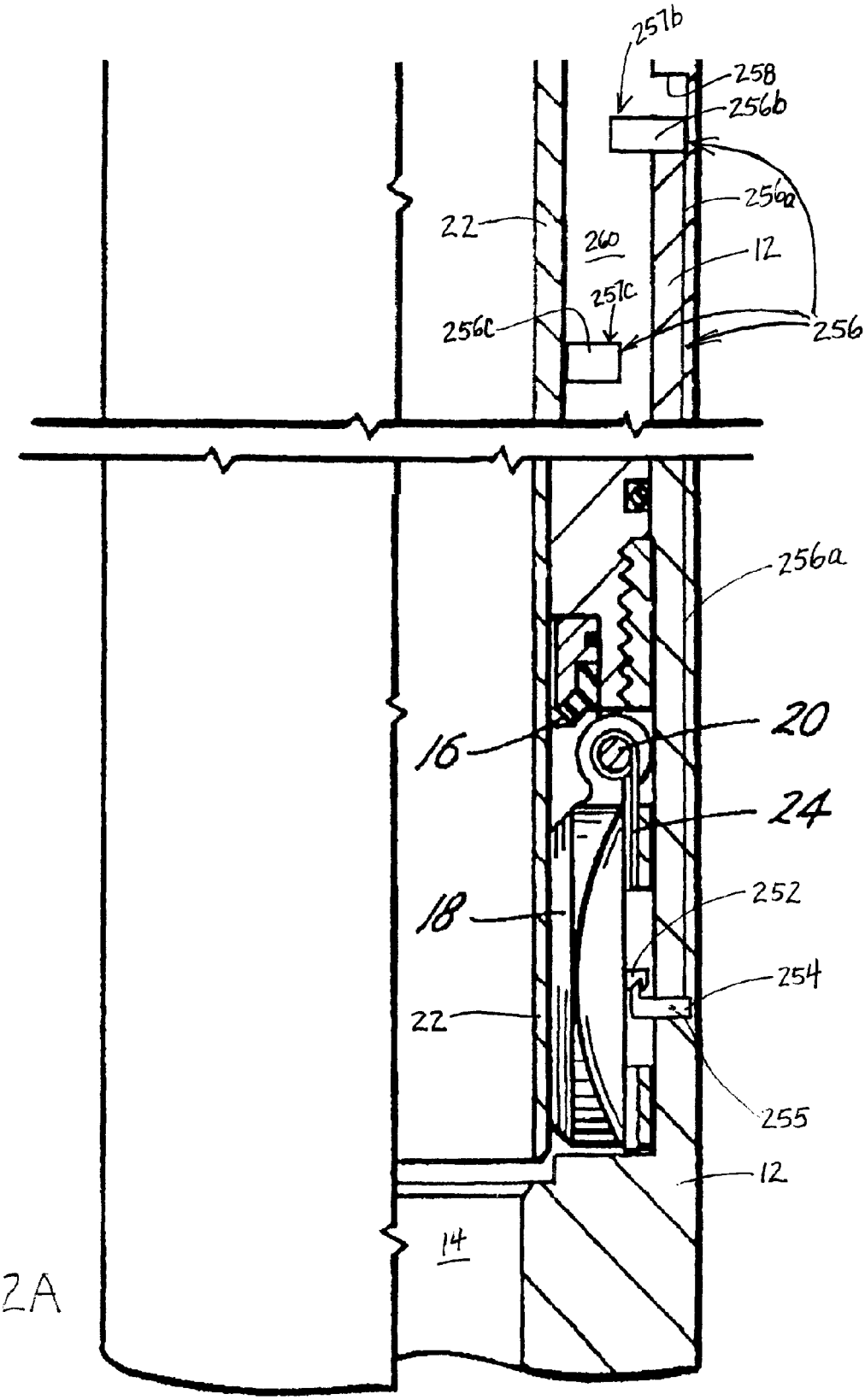
FIG. 2A is a detailed, fragmentary view of the safety valve portion of FIG. 1B, showing a flow tube adjacent a flapper valve that is held in an opening position by a mechanical latch assembly according to the present invention.
Figure 2B:
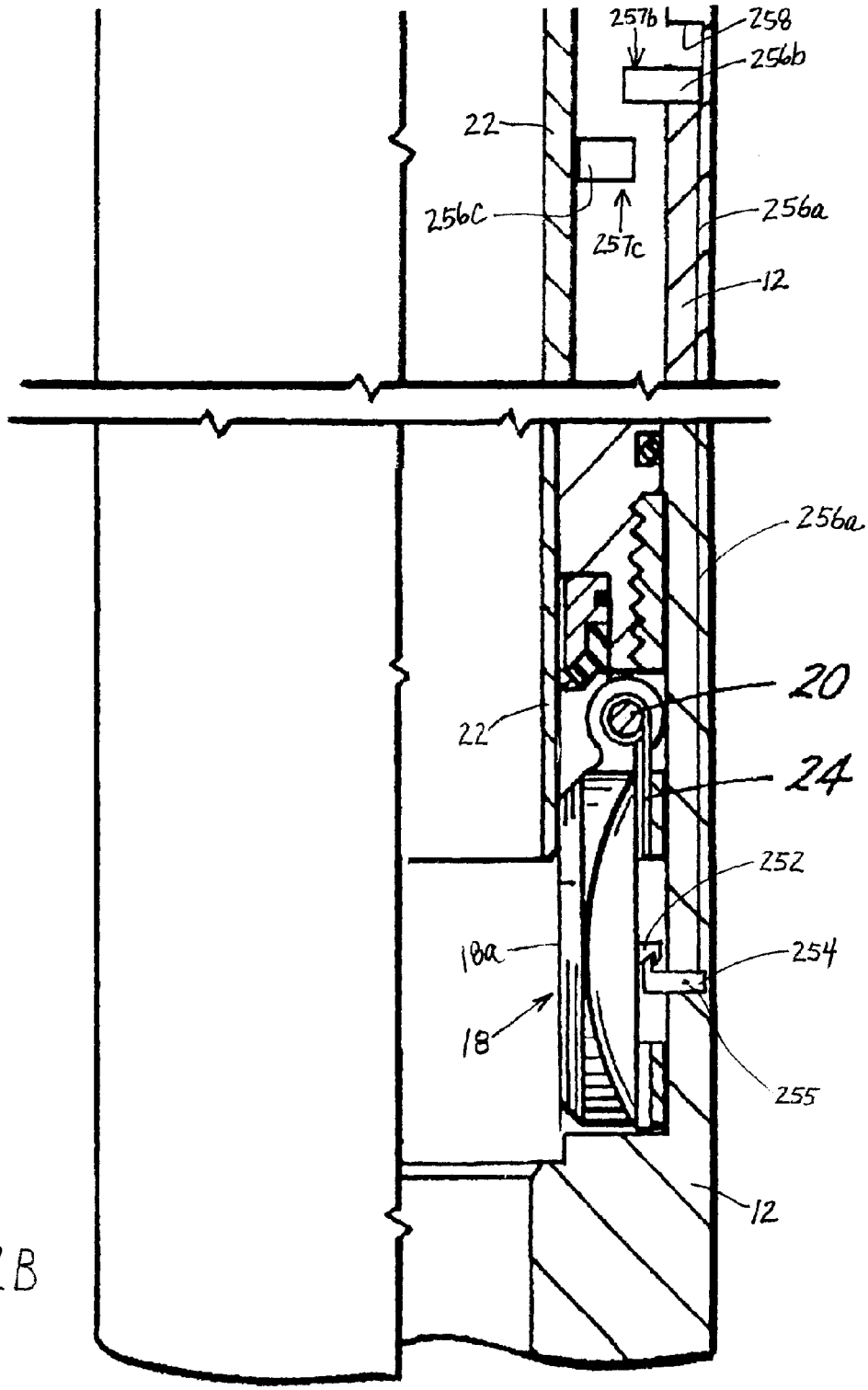
FIG. 2B illustrates movement of the flow tube relative to its position in FIG. 2A.
Figure 2C:
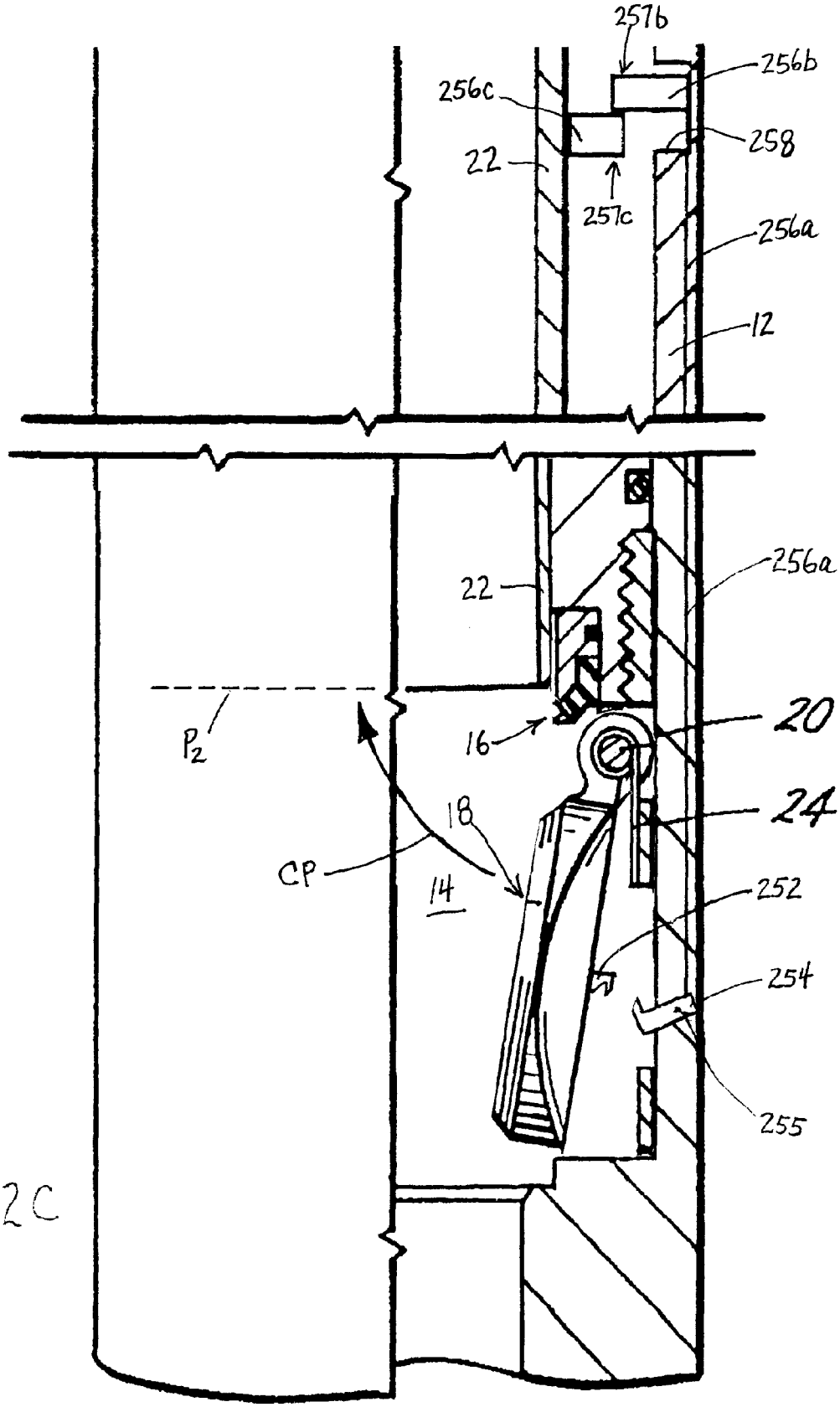
FIG. 2C illustrates further movement of the flow tube to a position actuating the latch assembly to release the flapper valve, thereby permitting movement of the flapper valve towards its closing position.

The actuator cable 256*a* is connected between the first boss member 256*a* and the latch 254 such that movement of the flow tube 22 from its first position (see FIG. 2A) to its second position (see FIG. 2C) forces the second boss member 256*c* into engagement with the first boss member 256*b*, resulting in pivotal movement of the latch 254 from its first position (see FIG. 2A) to its second position (see FIG. 2C). In this manner, the flapper valve 18 is urged to its closing position by the actuator 256 and the hinge spring 24 when the flow tube 22 is clear of the closure path CP.

Returning now to FIGS. 1A-1B, the safety valve 10 is controlled by the application or removal of a pressurized fluid, such as hydraulic fluid, through a control passageway 46 extending through the tubular body 12 and connected to a control line 32 that extends to the wellbore surface or the casing annulus (not shown). The control passageway 46 supplies a pressurized hydraulic fluid to the top of a piston 40 which in turn acts on the flow tube 22, via threaded connection 42, to urge the flow tube 22 downwardly towards its first position, thereby forcing the flapper valve 18 off of the seat 16 and into its opening position of FIGS. 1B and 2A.

The safety valve 10 further employs a second actuator, in the form of a biasing means such as a helical spring 26 or a pressurized chamber (not shown), for urging the flow tube 22 toward its second (upper) position. FIG. 1A shows a helical spring 26 disposed between a shoulder 28 on the tubular body 12 and a shoulder 30 on a portion of the flow tube 22 for yieldably urging the flow tube 22 upwardly to permit the flapper valve 18 to be moved to a position closing the safety valve 10. Accordingly, the magnitude of fluid pressure transmitted via the control line 32 and the control passageway 46 determines whether the flow tube 22 will be urged towards its first (lower) or second (upper) position.

When abnormal conditions such as a blowout occur, the fluid pressure in the control passageway 46 is reduced to an extent that the force of the biasing spring 26 overcomes the force of the reduced control fluid pressure and urges the flow tube 22 upwardly. This is illustrated in the flow tube's upward movement from the first (lower) position of FIG. 2A to the intermediate position of FIG. 2B.

Figure 2D:
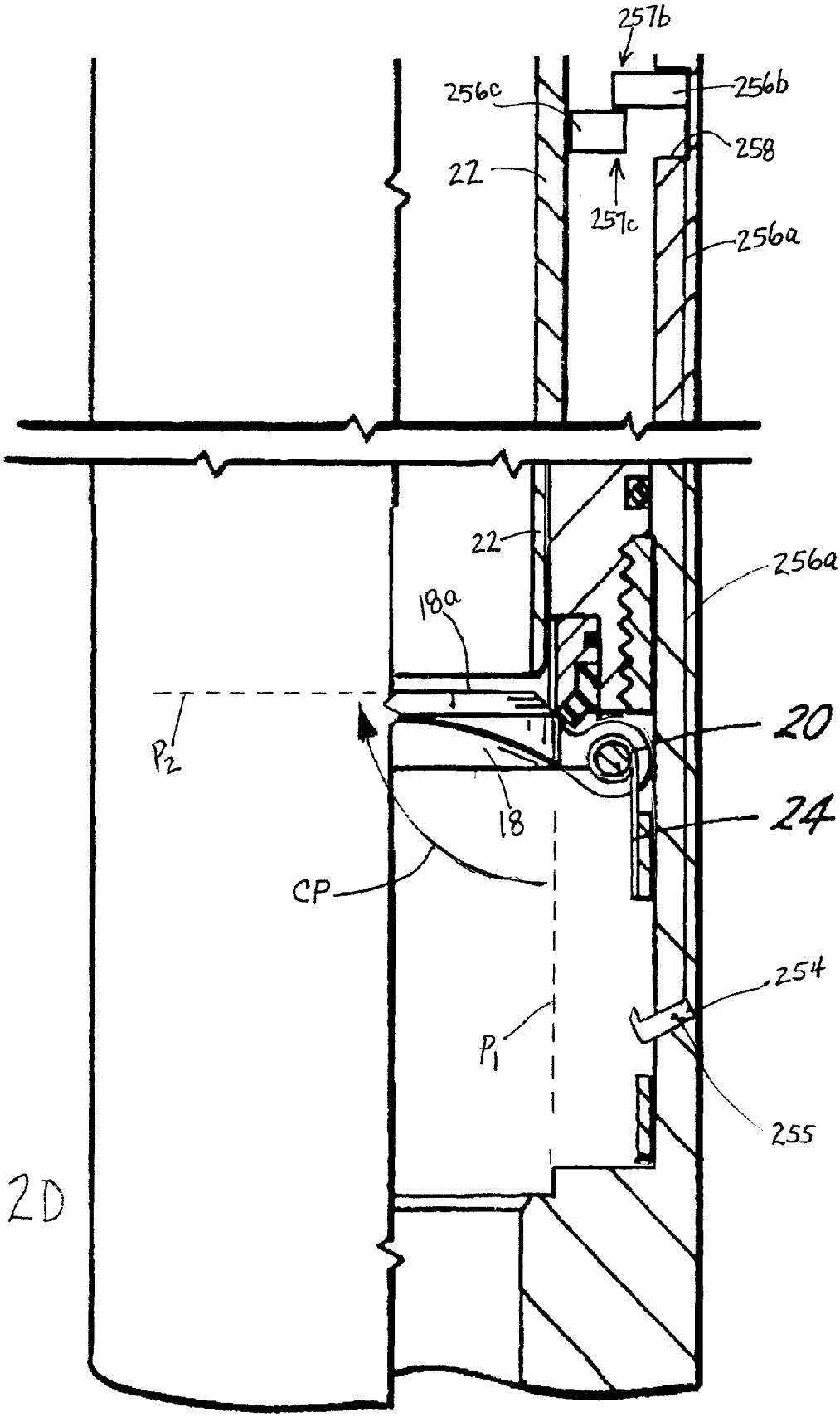
FIG. 2D illustrates the flapper valve moved to its closing position and the flow tube moved to a position clear of the flapper valve closure path.

In conventional safety valves, the flapper valve 18 would begin closing as soon as the flow tube 22 was moved clear of the leading surface 18*a* of the flapper valve, so as to shut off flow to the safety valve 10 and well tubing 11. However, the release of the flapper valve 18 is delayed in accordance with the present invention until the flow tube 22 has been urged clear of the flapper valve's closure path CP (see FIGS. 2C-2D) by the action of the biasing spring 26 (see FIG. 1A) and the fluid pressure in the flow passageway 14. FIG. 2C shows the flow tube 22 just after it has moved clear of the closure path CP to a position beyond the valve seat 16, thereby "triggering"—by way of engagement between the actuator boss members 256*b*, 256*c*—the movement of the actuator cable 256*a*, and pivoting the latch 254 to release the keeper 252 from the latch. FIG. 2D shows the flapper valve 18 completely closed and the flow tube 22 moved slightly upward from its position of FIG. 2C, whereby the first boss member 256*b* has been pushed by the second boss member 256*c* to the upper end of the axial slot 258. This delayed closing of the flapper valve 18 prevents the flapper valve from impacting the lower end of the flow tube 22 as the flapper mechanism is closed, thereby avoiding damage to the flow tube 22 and/or the flapper and hinge components (18, 20) and permitting the flow tube to employ a reduced wall thickness and a correspondingly increased internal diameter.

Figure 3:
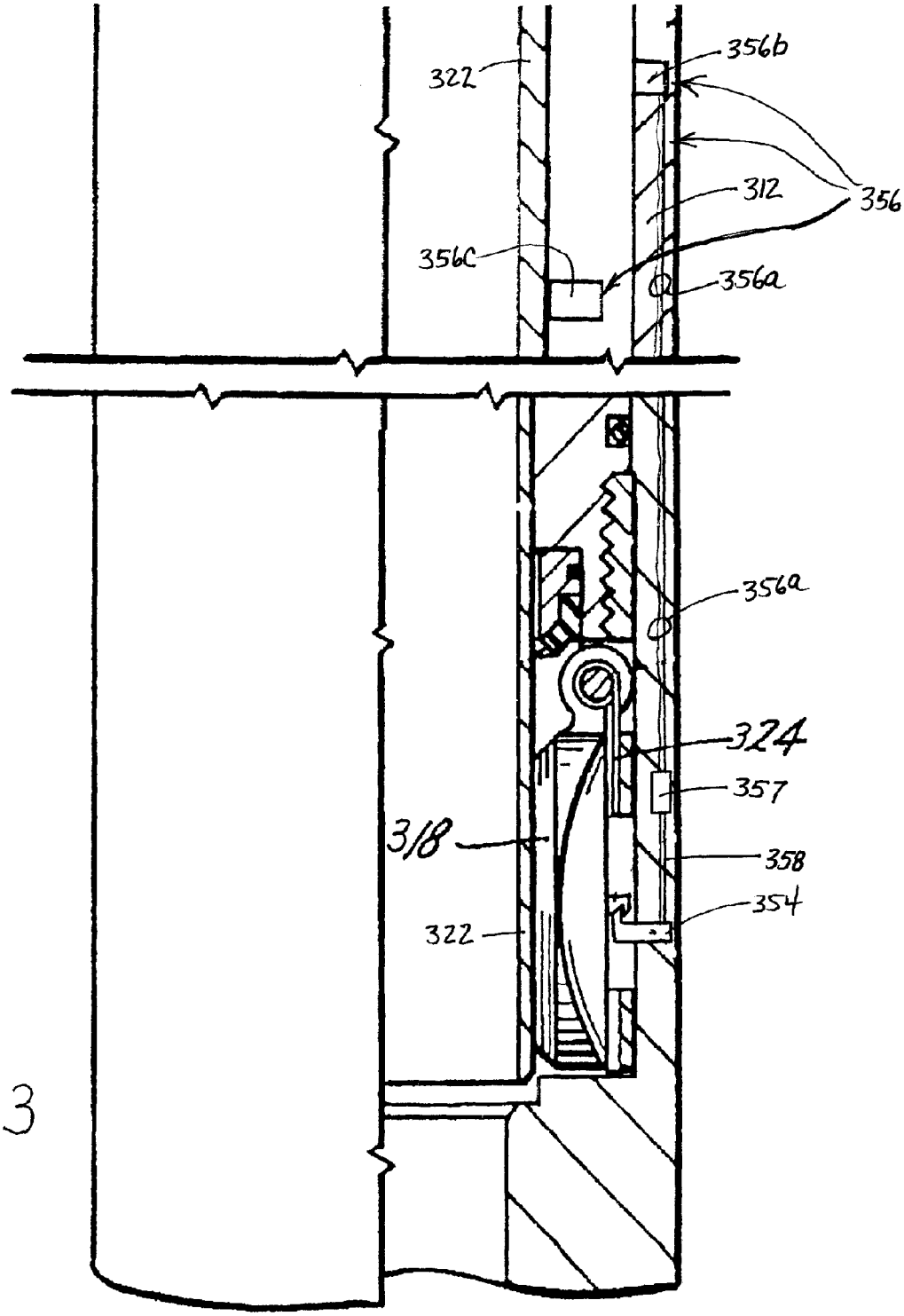
FIG. 3 is a detailed, fragmentary view of an alternative safety valve, showing a flow tube adjacent a flapper valve that is held in an opening position by an electromechanical latch assembly according to the present invention.

It will be appreciated that the latch actuator is not limited to the mechanical latch actuator 256 described above. FIG. 3 is a detailed, fragmentary view of an alternative safety valve that employs an electromechanical latch actuator 356 according to the present invention. The latch actuator 356 comprises a first position sensor element 356*b* carried by the tubular body 312, and a second position sensor element 356*c* carried by the flow tube 322 for movement therewith. The position sensor elements may be chosen from several types known to those having ordinary skill in the art, such as, e.g., magnetostriction linear-position sensors. The first position sensor element 356*b* generates a release signal when the flow tube 322 is moved to a position that axially aligns the two position-sensing elements 356*b*, 356*c* (aligning position not shown).

The electromechanical actuator 356 further comprises an electromechanical linkage, in the form of a linear solenoid 357, an electrical clutch (not shown), or other equivalent means thereto. The linear solenoid 357 is operatively connected between the first position sensor element 356*b* and the latch 354 by way of conducting wires 356*a* that are adapted for conveying the release signal from the first position sensor element 356*b* when the signal is generated. Accordingly, movement of the flow tube 322 from its first (lower) position to its second (upper) position aligns—at least for an instant—the second position sensor element 356*c* with the first position sensor element 356*b*, resulting in the transmission of a release signal to the linear solenoid 357 via the wires 356*a*. This produces movement of the solenoid core (not separately shown) and plunger 358, effecting movement of the latch 354 from its first position to its second position. In this manner, the flapper valve 318 is urged to its closing position by the first actuator 324 when the flow tube 322 is clear of the closure path.

In summary, those having ordinary skill in the art will appreciate that the present invention may be advantageously employed for controlling fluid flow through a fluid passageway in a tubular body disposed in a wellbore, without subjecting a flow tube or a valve closure member to damaging impact therebetween. The flow tube is urged within the tubular body to a first position preventing the valve closure member from moving under its spring bias through a closure path from a position opening the fluid passageway to a position closing the fluid passageway. In the presence of certain conditions, such as uncontrolled pressure release emergencies (particularly blowouts), the flow tube is urged to a second position permitting movement of the valve closure member under its spring bias. However, the valve closure member is secured in the opening position until the flow tube has been moved clear of the closure path.

It will be understood from the foregoing description that various modifications and changes may be made in the preferred and alternative embodiments of the present invention without departing from its true spirit. For example, various valve closure member types and latch actuator types may be employed to advantage in accordance with the present invention.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open set or group. Similarly, the terms "containing," having," and "including" are all intended to mean an open set or group of elements. "A," "an" and other singular terms are intended to include the plural forms thereof unless specifically excluded. It is the express intention of the applicant not to invoke 35 U.S.C. § 112, paragraph 6 for any limitations of any of the claims herein, except for those in which the claim expressly uses the words "means for" together with an associated function.

What is claimed is:

1. A subsurface safety valve usable with a wellbore, comprising:

a tubular body adapted for placement within the wellbore and defining a fluid passageway; a valve closure member carried by the tubular body and movable through a closure path between positions opening and closing the fluid passageway;

a first actuator for urging the valve closure member to its closing position; a flow tube axially-movable within the tubular body between a first position preventing the first actuator from urging the valve closure member to its closing position and a second position permitting the first actuator to urge the valve closure member to its closing position, the flow tube comprising an end; and a latch assembly adapted to:

when the flow tube is in the first position, be placed in a first state in which the latch assembly secures the closure member to prevent movement of the valve closure member into the valve closure path; and in response to the end of the flow tube clearing the valve closure path such that the entire flow tube is clear of the valve closure path, transition from the first state to a second state in which the latch assembly releases the valve closure member to allow the valve closure member to move through the valve closure path to a closed position.

2. The safety valve of claim 1, wherein the valve closure member is a flapper carried by the tubular body for pivotal movement through an arcuate closure path.

3. The safety valve of claim 2, wherein the first actuator comprises a hinge spring.

4. The safety valve of claim 1, wherein the first actuator comprises a spring.

5. The safety valve of claim 1, further comprising a control passageway in the tubular body for transmitting fluid pressure from the surface for urging the flow tube towards its first position.

6. The safety valve of claim 5, further comprising a second actuator for urging the flow tube toward its second position, whereby the magnitude of fluid pressure transmitted via the control passageway determines whether the flow tube will be urged towards its first or second position.

7. The safety valve of claim 6, wherein the second actuator comprises a spring.

8. The safety valve of claim 7, wherein the spring is a helical spring disposed between a shoulder carried by the tubular body and a shoulder carried by the flow tube.

9. The safety valve of claim 1, wherein the latch is carried by the tubular body for pivotal movement between a first position for operatively engaging the keeper and a second position for releasing the keeper, the latch comprising a spring for biasing the latch towards its first position.

10. The safety valve of claim 9, wherein the tubular body and the flow tube define an annulus therebetween, and the latch actuator comprises a first boss member slidably carried within an axial slot in the tubular body and having a portion protruding into the annulus;

a second boss member carried by the flow tube for movement therewith and having a portion protruding into the annulus, the protruding portions of the first and second boss members interfering radially with one another such that neither can be moved axially through the length of the annulus without engaging the other; and a linkage connected between the first boss member and the latch such that movement of the flow tube from its first position to its second position forces the second boss member into engagement with the first boss member, resulting in pivotal movement of the latch from its first position to its second position, whereby the valve closure member is urged to its closing position by the first actuator when the flow tube is clear of the closure path.

11. The safety valve of claim 9, wherein the latch actuator comprises a first position sensor element carried by the tubular body;

a second position sensor element carried by the flow tube for movement therewith, at least one of the first and second position sensor elements generating a release signal when the flow tube is moved to a position that axially aligns the two position-sensing elements; and an electromechanical actuator operatively connected between the one signal-generating position sensor element and the latch such that movement of the flow tube from its first position to its second position aligns the second position sensor element with the first position sensor element, resulting in the transmission of a release signal to the electromechanical actuator and the movement of the latch from its first position to its second position, whereby the valve closure member is urged to its closing position by the first actuator when the flow tube is clear of the closure path.

12. The safety valve of claim 1, wherein the latch assembly comprises a keeper carried by the valve closure member;

a latch carried by the tubular body for operatively engaging the keeper; and an actuator for releasing the keeper from the latch.

13. A system for actuating a valve closure member within a subsurface safety valve having a tubular body adapted for placement within a wellbore and defining a fluid passageway, the valve closure member being carried by the tubular body for movement through a closure path between positions opening and closing the fluid passageway, the safety valve further having a first actuator for urging the valve closure member to its closing position, and a flow tube axially-movable within the tubular body between a first position preventing the first actuator from urging the valve closure member to its closing position and a second position permitting the first actuator to urge the valve closure member to its closing position, the actuating system comprising:

a latch assembly adapted to:

when the flow tube is in the first position, be placed in a first state in which the latch assembly secures the closure member to prevent movement of the valve closure member into the valve closure path; and in response to an end of the flow tube clearing the valve closure path such that the entire flow tube is clear of the valve closure path, transition from the first state to a second state in which the latch assembly releases the valve closure member to allow the valve closure member to move through the valve closure path to a closed position.

14. The actuating system of claim 13, wherein the latch actuator is one of mechanical and electromechanical.

15. The system of claim 13, wherein the latch assembly comprises a keeper carried by the valve closure member;

a latch carried by the tubular body for operating engaging the keeper; and an actuator for releasing the keeper from the latch.

16. A method for controlling fluid flow through a fluid passageway in a tubular body disposed in a wellbore, comprising:

urging a flow tube within the tubular body to a first position preventing a valve closure member from moving under a spring bias through a closure path from a position opening the fluid passageway to a position closing the fluid passageway;

urging the flow tube a second position permitting movement of the valve closure member under the spring bias;

engaging a latch assembly when the flow tube is in the first position to prevent movement of the valve closure member into the closure path; and in response to an end of the flow tube clearing the closure path such that the entire flow tube is clear of the closure path, releasing the valve closure member to allow the valve closure member to move through the closure path to a closed position.

17. The method of claim 16, wherein the act of urging the flow tube to the first position comprises applying fluid pressure from a surface location.

18. The method of claim 16, wherein the act of urging the flow tube to the second position comprises reducing fluid pressure from the surface location, and applying a spring bias force against the flow tube that opposes and exceeds the force of the reduced fluid pressure.

19. The method of claim 16, wherein the latch assembly comprises:

a keeper carried by the valve closure member;

a latch carried by the tubular body for operating engaging the keeper; and an actuator for releasing the keeper from the latch.

20. A subsurface safety valve for controlling fluid flow through a wellbore, comprising:

a tubular body adapted for placement within the wellbore and defining a fluid passageway;

a valve closure member carried by the tubular body and movable through a closure path between positions opening and closing the fluid passageway;

a first actuator for urging the valve closure member to its closing position; a flow tube axially-movable within the tubular body between a first position preventing the first actuator from urging the valve closure member to its closing position and a second position permitting the first actuator to urge the valve closure member to its closing position; and a latch assembly for preventing movement of the valve closure member from its opening position to its closing position until the flow tube has been urged clear of the closure path, wherein the latch assembly comprises a keeper carried by the valve closure member; a latch carried by the tubular body for operatively engaging the keeper; and an actuator for releasing the keeper from the latch, and wherein the latch is carried by the tubular body for pivotal movement between a first position for operatively engaging the keeper and a second position for releasing the keeper, the latch comprising a spring for biasing the latch towards its first position.

21. A subsurface safety valve for controlling fluid flow through a wellbore, comprising:

a tubular body adapted for placement within the wellbore and defining a fluid passageway;

a valve closure member carried by the tubular body and movable through a closure path between positions opening and closing the fluid passageway;

a first actuator for urging the valve closure member to its closing position;

a flow tube axially-movable within the tubular body between a first position preventing the first actuator from urging the valve closure member to its closing position and a second position permitting the first actuator to urge the valve closure member to its closing position; and a latch assembly for preventing movement of the valve closure member from its opening position to its closing position until the flow tube has been urged clear of the closure path, wherein the latch assembly comprises a keeper carried by the valve closure member;

a latch carried by the tubular body for operatively engaging the keeper; and an actuator for releasing the keeper from the latch, and wherein the latch is carried by the tubular body for pivotal movement between a first position for operatively engaging the keeper and a second position for releasing the keeper, the latch comprising a spring for biasing the latch towards its first position, and wherein the tubular body and the flow tube define an annulus therebetween, and the latch actuator comprises a first boss member slidably carried within an axial slot in the tubular body and having a portion protruding into the annulus; a second boss member carried by the flow tube for movement therewith and having a portion protruding into the annulus, the protruding portions of the first and second boss members interfering radially with one another such that neither can be moved axially through the length of the annulus without engaging the other; and a linkage connected between the first boss member and the latch such that movement of the flow tube from its first position to its second position forces the second boss member into engagement with the first boss member, resulting in pivotal movement of the latch from its first position to its second position, whereby the valve closure member is urged to its closing position by the first actuator when the flow tube is clear of the closure path.

22. A subsurface safety valve for controlling fluid flow through a wellbore, comprising:

a tubular body adapted for placement within the wellbore and defining a fluid passageway;

a valve closure member carried by the tubular body and movable through a closure path between positions opening and closing the fluid passageway;

a first actuator for urging the valve closure member to its closing position;

a flow tube axially-movable within the tubular body between a first position preventing the first actuator from urging the valve closure member to its closing position and a second position permitting the first actuator to urge the valve closure member to its closing position; and a latch assembly for preventing movement of the valve closure member from its opening position to its closing position until the flow tube has been urged clear of the closure path, wherein the latch assembly comprises a keeper carried by the valve closure member;

a latch carried by the tubular body for operatively engaging the keeper; and an actuator for releasing the keeper from the latch, and wherein the latch is carried by the tubular body for pivotal movement between a first position for operatively engaging the keeper and a second position for releasing the keeper, the latch comprising a spring for biasing the latch towards its first position, and wherein the latch actuator comprises a first position sensor element carried by the tubular body;

a second position sensor element carried by the flow tube for movement therewith, at least one of the first and second position sensor elements generating a release signal when the flow tube is moved to a position that axially aligns the two position-sensing elements; and an electromechanical actuator operatively connected between the one signal-generating position sensor element and the latch such that movement of the flow tube from its first position to its second position aligns the second position sensor element with the first position sensor element, resulting in the transmission of a release signal to the electromechanical actuator and the movement of the latch from its first position to its second position, whereby the valve closure member is urged to its closing position by the first actuator when the flow tube is clear of the closure path.

23. A system for actuating a valve closure member within a subsurface safety valve having a tubular body adapted for placement within a wellbore and defining a fluid passageway, the valve closure member being carried by the tubular body for movement through a closure path between positions opening and closing the fluid passageway, the safety valve further having a first actuator for urging the valve closure member to its closing position, and a flow tube axially-movable within the tubular body between a first position preventing the first actuator from urging the valve closure member to its closing position and a second position permitting the first actuator to urge the valve closure member to its closing position, the actuating system comprising a latch assembly for preventing movement of the valve closure member from its opening position to its closing position until the flow tube has been urged clear of the closure path, wherein the latch assembly comprises a keeper carried by the valve closure member; a latch carried by the tubular body for operatively engaging the keeper; and an actuator for releasing the keeper from the latch, and wherein the latch actuator is one of mechanical and electromechanical.

* * * * *